US009338539B2

(12) United States Patent
Chen

(10) Patent No.: US 9,338,539 B2
(45) Date of Patent: May 10, 2016

(54) IN-EAR-CANAL HEADSET ASSEMBLY

(71) Applicant: DEXIN CORPORATION, New Taipei (TW)

(72) Inventor: Yi-Shun Chen, New Taipei (TW)

(73) Assignee: DEXIN CORPORATION, New Taipei (TW)

( * ) Notice: Subject to any disclaimer, the term of this patent is extended or adjusted under 35 U.S.C. 154(b) by 20 days.

(21) Appl. No.: 14/329,919

(22) Filed: Jul. 12, 2014

(65) Prior Publication Data

US 2016/0014493 A1 Jan. 14, 2016

(51) Int. Cl.

*H04R 1/10* (2006.01)
*H04R 1/08* (2006.01)
*H04R 1/28* (2006.01)

(52) U.S. Cl.

CPC ..... *H04R 1/1016* (2013.01); *H04R 1/083* (2013.01); *H04R 1/2807* (2013.01); *H04R 2201/107* (2013.01)

(58) Field of Classification Search

CPC ..... H04R 2225/023; H04R 2225/025; H04R 1/10; H04R 2205/022; H04R 1/105; H04R 5/0335; H04R 2201/10; H04R 2460/13; H04R 1/1016

USPC ..... 381/328, 370–371, 374–375, 380–382

See application file for complete search history.

(56) References Cited

U.S. PATENT DOCUMENTS 7,099,464 B2 * 8/2006 Lucey ..... H04M 1/05 381/381
7,570,777 B1 * 8/2009 Taenzer ..... H04R 25/00 381/381
8,019,092 B2 * 9/2011 Yuan ..... A61F 11/06 381/381
8,090,135 B2 * 1/2012 Lin ..... H04R 1/083 381/381
8,611,582 B2 * 12/2013 Lee ..... H04M 1/05 381/381

* cited by examiner

*Primary Examiner* — Suhan Ni
(74) *Attorney, Agent, or Firm* — Li & Cai Intellectual Property (USA) Office

(57) ABSTRACT

An in-ear-canal headset assembly includes an accommodating housing, a speaker unit, a fixing unit, an in-ear unit and a microphone unit. The accommodating housing has a resonance chamber, a sound chamber in air communication with the resonance chamber, and an outer cover covering the resonance chamber. The resonance chamber receives a socket therein. The speaker unit is received in the sound chamber. The fixing unit has a ring portion disposed around the sound chamber and a hooking portion connected to the ring portion. The in-ear unit has a covering lid covering the sound chamber, a wave-guiding tube extending from the covering lid, and a flexible tip fixed on the wave-guiding tube. The microphone unit has an arm, an earphone plug, a microphone disposed on an end of the arm, and a connecting cord arranged on the arm for electrically connecting the earphone plug to the microphone.

9 Claims, 7 Drawing Sheets

IN-EAR-CANAL HEADSET ASSEMBLY

BACKGROUND

1. Field of the Invention

The instant disclosure relates to an in-ear-canal headset assembly; in particular, to a headset which combines a canalphone and a microphone.

2. Description of Related Art

To improve the sound-insulation effect of earphone, canalphones also called in-ear earphone or generally called In-Ear-Monitor (IEM), has been developed. Canalphones are a specific type of earphone that is meant to seal the opening of your ear canal (external acoustic meatus) by inserting a rubber tip to prevent interference from ambient sound. Therefore, the ambient noise can be reduced and a better seal characteristic is provided.

A headset is a device that combines a headphone with a microphone. If in-ear earphones are applied to a headset, which could be called in-ear-canal headset, the total weight of the headset is increased because a microphone unit is added. Since the in-ear earphones are only fixed by inserting the rubber tip at the entrance of user's ear canal, to wear the in-ear-canal headset on user's ear will cause some difficulty. Because the microphone is extended from the ear toward the mouth, a rotating torque exists which can easily affect the wearing stability of in-ear headset.

BRIEF SUMMARY OF THE INVENTION

The instant disclosure provides an in-ear-canal headset assembly, which combines a microphone with an in-ear earphone and enhances the wearing stability for user.

In addition, the instant disclosure further provides an in-ear-canal headset assembly, which provides a light microphone unit combined with the in-ear earphone to reduce the total weight of microphone unit and increase wearing stability of in-ear-canal headset assembly.

According to one exemplary embodiment of the instant disclosure, an in-ear-canal headset assembly is disclosed, which includes an accommodating housing, a speaker unit, a fixing unit, an in-ear unit and a microphone unit. The accommodating housing has a resonance chamber, a sound chamber in air communication with the resonance chamber, and an outer cover arranged at a side of the resonance chamber. A socket is received in the resonance chamber. The speaker unit is received in the sound chamber. The fixing unit has a ring portion and a hooking portion connected to a periphery of the ring portion. The ring portion is disposed around a periphery of the sound chamber. The hooking portion is rested on a user's auricle. The in-ear unit has a covering lid covering the sound chamber, a wave-guiding tube extending outward from the covering lid, and a flexible tip connected to the wave-guiding tube. The microphone unit has an arm, an earphone plug disposed at one end of the arm and plugged in the socket, a microphone disposed at another end of the arm, and a connecting cord arranged on the arm. The earphone plug is extending along a longitudinal direction of the arm. The connecting cord is electrically connected to the earphone plug and the microphone.

According to one embodiment of the instant disclosure, the arm of the microphone unit is a plate shaped and has a plurality of through holes formed thereon and two sides. The connecting cord is passed through the through holes circuitously and arranged at the two sides of the arm alternately in a wavelike pattern.

The instant disclosure has benefits as followed. The in-ear-canal headset assembly of the instant disclosure includes a fixing unit. The fixing unit has a ring portion and a hooking portion connected to the ring portion. The hooking portion can be rested on the user' auricle to increase the wearing stability. Further, the ring portion can provide friction force against the ear to increase fixing ability.

In order to further understand the instant disclosure, the following embodiments are provided along with illustrations to facilitate the appreciation of the instant disclosure; however, the appended drawings are merely provided for reference and illustration, without any intention to be used for limiting the scope of the instant disclosure.

DETAILED DESCRIPTION OF THE INVENTION

The aforementioned illustrations and following detailed descriptions are exemplary for the purpose of further explaining the scope of the instant disclosure. Other objectives and advantages related to the instant disclosure will be illustrated in the subsequent descriptions and appended drawings.

Figure 1:
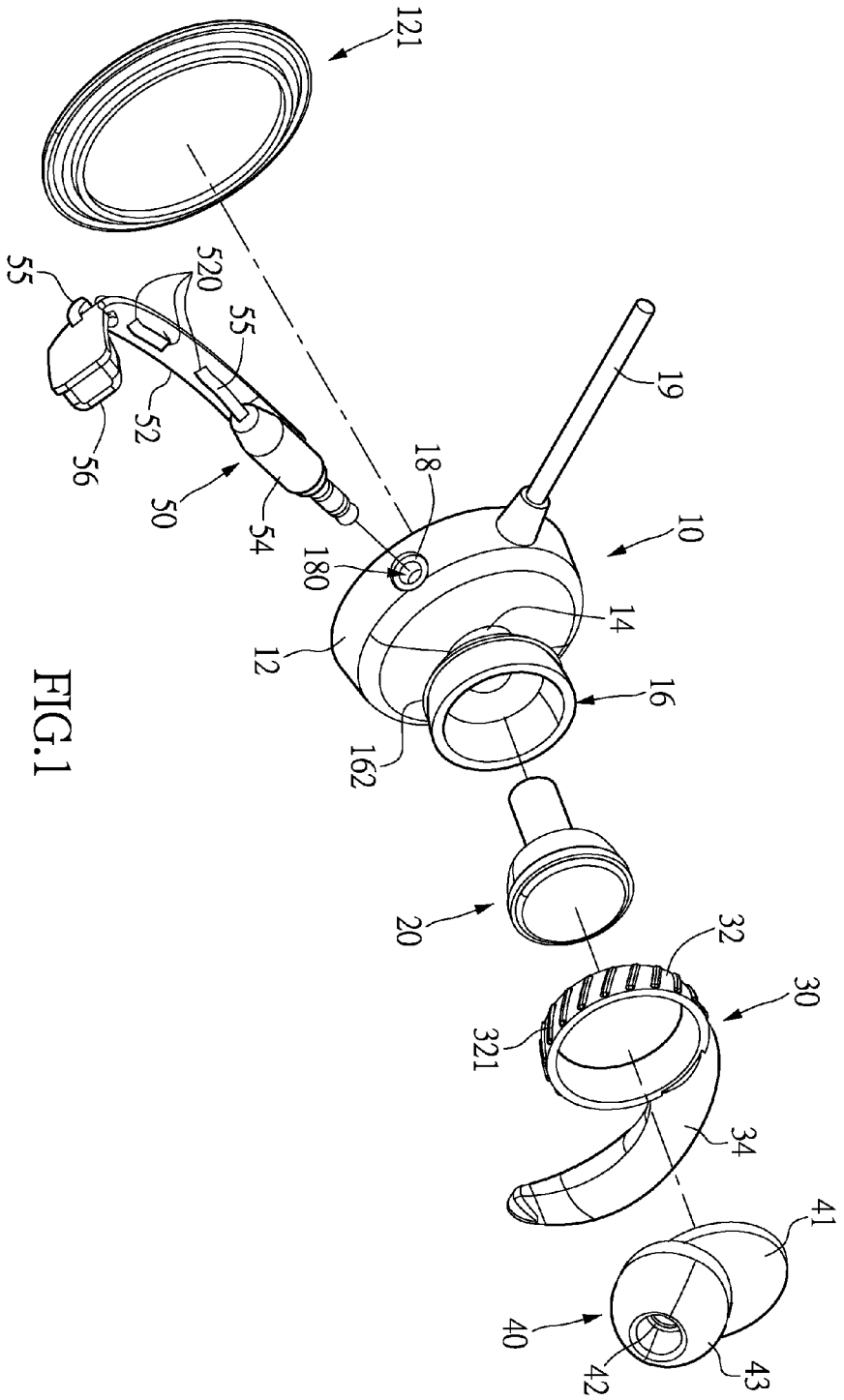
FIG. 1 is a perspective exploded view of an in-ear-canal headset assembly of the instant disclosure.
Figure 2:
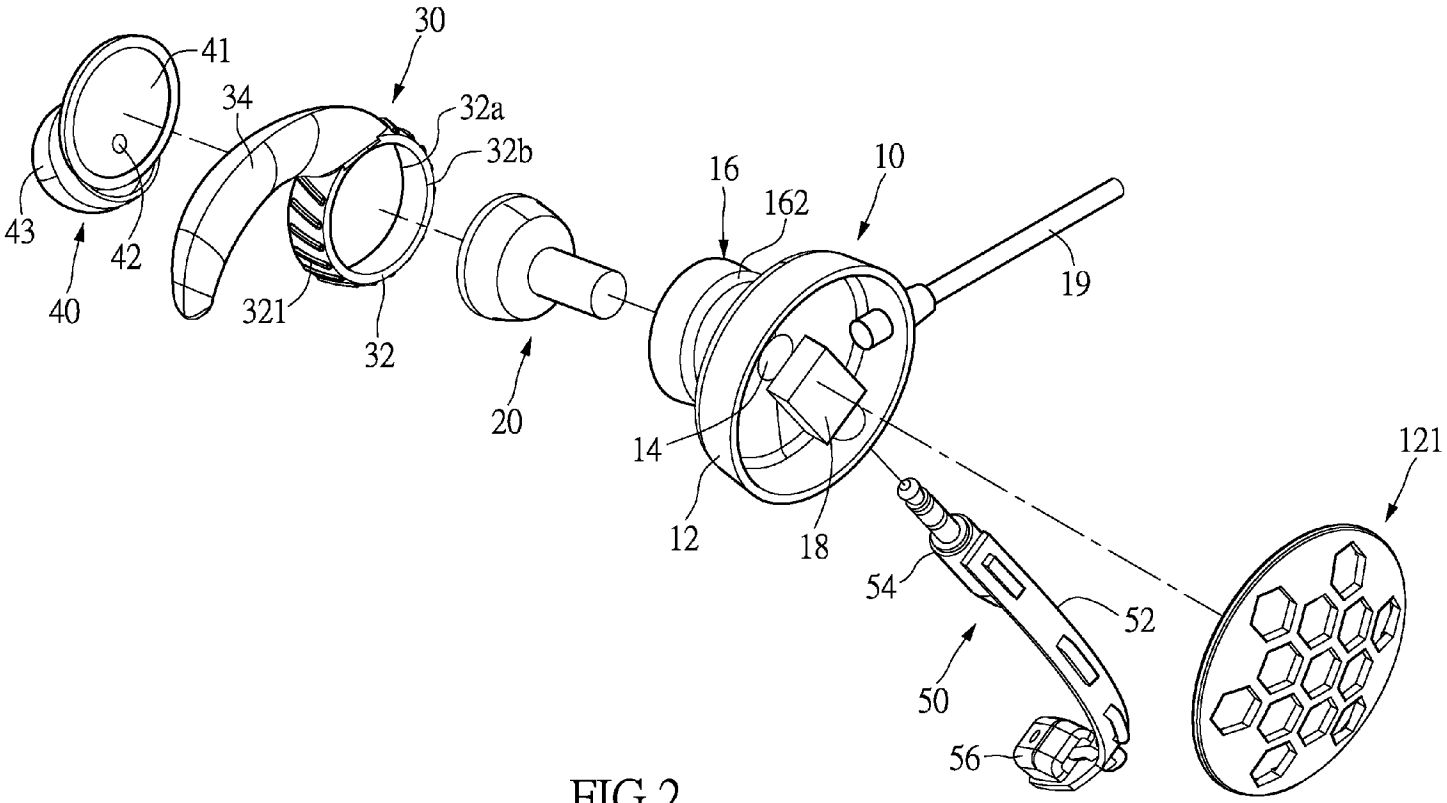
FIG. 2 is another perspective exploded view of the in-ear-canal headset assembly of the instant disclosure.

Please refer to FIGS. 1 and 2 as the perspective exploded views of an in-ear-canal headset assembly. The instant disclosure provided an in-ear-canal headset assembly, which has an accommodating housing 10, a speaker unit 20, a fixing unit 30, an in-ear unit 40, and a microphone unit 50.

The accommodating housing 10 has a resonance chamber 12, a sound chamber 16 in air communication with the resonance chamber 12, and an outer cover 121 is arranged at a side of the resonance chamber 12. Further, there is a socket 18 received in the resonance chamber 12. In this embodiment, the accommodating housing 10 further includes a neck portion 14 in air communication the resonance chamber 12 with the sound chamber 16. The sound chamber 16 has a ring-shaped blocking protrusion 162 formed on an outer surface thereof adjacent to the neck portion 14.

The speaker unit 20 is received in the sound chamber 16. The speaker unit 20 has a sound-playing side opposite to the resonance chamber 12. The speaker unit 20 can be moving-coil type or balanced armature, or a combination of both.

Figure 7:
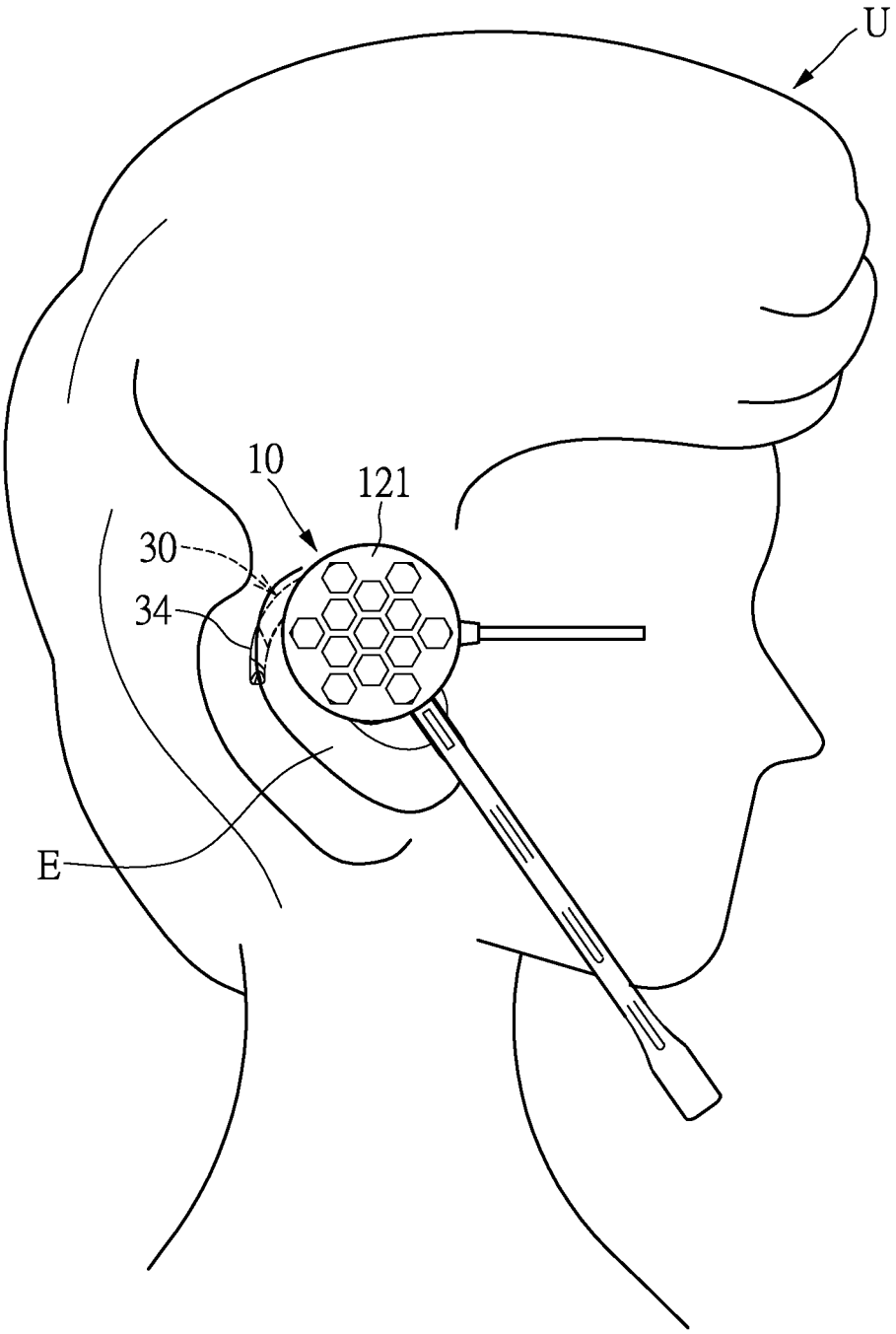
FIG. 7 is a perspective view showing the in-ear-canal headset assembly of the instant disclosure being worn.

The fixing unit 30 includes a ring portion 32 and a hooking portion 34 connected to a periphery of the ring portion 32. The fixing unit 30 could be made of flexible plastic. The hooking portion 34 has substantially a crescent shape, which is integrally protruded from the ring portion 32. The ring portion 32 is arranged around the sound chamber 16, and the hooking portion 34 is hooked on the user's auricle, as shown in FIG. 7. Besides, the fixing unit 30 has a plurality of anti-sliding portions 321 formed on an outer surface of the ring portion 32.

The anti-sliding portion 321 provides anti-sliding function to retain the in-ear-canal headset assembly of this embodiment on the user's auricle and improves wearing stability.

The in-ear unit 40 includes a covering lid 41 covering the sound chamber 16, a wave-guiding tube 42 extending outward from the covering lid 41, and a flexible tip 43 connected to the wave-guiding tube 42. The flexible tip 43 is put in the user' external auditory canal.

The microphone unit 50 includes an arm 52, an earphone plug 54 disposed at one end of the arm 52, a microphone 56 is disposed at the other end of the arm 52, and a connecting cord 55 arranged on the arm 52. The earphone plug 54 is plugged in the socket 18. The earphone plug 54 is extended along a longitudinal direction of the arm 52. The connecting cord 55 is electrically connected the earphone plug 54 and the microphone 56.

For reducing total weight, in this embodiment, the connecting cord 55 is wavelike and passes through the arm 52. The arm 52 of the microphone unit 50 is a plate-shaped and formed with a plurality of through holes 520. The arm 52 preferably can be a metal plate, or an elastic plastic board. The connecting cord 55 is wavelike and passes through the through holes 520 and is alternatively arranged on two sides of the arm 52. Such structure arrangement is different from the conventional way that uses a plastic tube to wrap and hold a connecting cord therein. This embodiment not only can reduce the weight of the microphone unit 50, but also reduce the total thickness. The through holes 520 are arrange in order along a central line of the plate-shaped arm 52, but it is not limited thereto. For example, the through holes can be in air communication with an edge of the arm 52, or can be arranged at two sides of the central line of the arm 52.

The earphone plug 54 and the microphone 56 of the microphone unit 50 are arranged on the identical side of the arm 52. The arm 52 and the hooking portion 34 extend in opposite directions. Besides, in this embodiment, the socket 18 has a plugging slot 180, and the plugging slot 180 is substantially configured in parallel to a human's cheek.

Please refer to FIG. 2. The sound chamber 16 and the neck portion 14 are shaped as a funnel. The sound chamber 16 is gradually narrowed from one end of the covering lid 41 toward the neck portion. The ring portion 32 of the fixing unit 30 has an inner opening 32*a*, arranged adjacent to the covering lid 41 and an outer opening 32*b*, arranged adjacent to the neck portion 14. The inner opening 32*a*, has a diameter larger than a diameter of the outer opening 32*b*. In this embodiment, one end closed to the user's ear is defined as inner side, and the other end far away the user's ear is defined as outer side. In other words, the sound chamber 16 is oblique with respect to the resonance chamber 12, and the ring portion 32 is tapered and ring-shaped. The ring portion 32 is assembled to the sound chamber 16, and is coupled to the blocking protrusion 162 of the sound chamber 16. Thus, the ring portion 32 can be stably mounted on the sound chamber 16. Notably, a diameter of the covering lid 41 is larger than a diameter of the inner opening 32*a*. The covering lid 41 and the blocking protrusion 162 cooperatively plug two sides of the ring portion 32.

Figure 3:
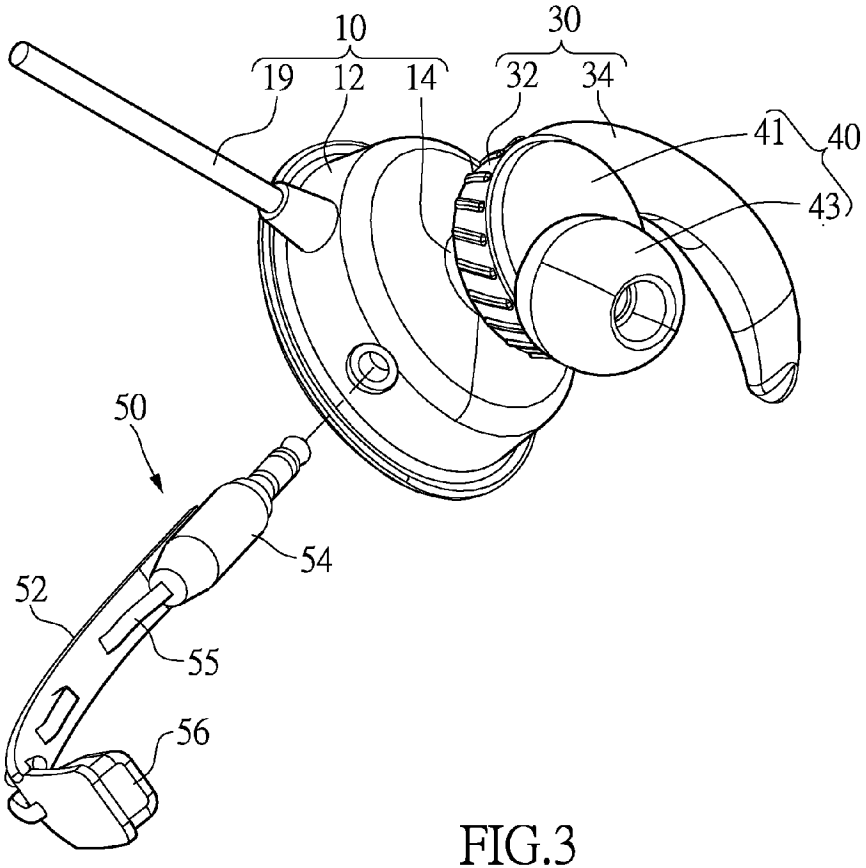
FIG. 3 is a perspective view of the in-ear-canal earphone separated from a microphone of the instant disclosure.
Figure 4:
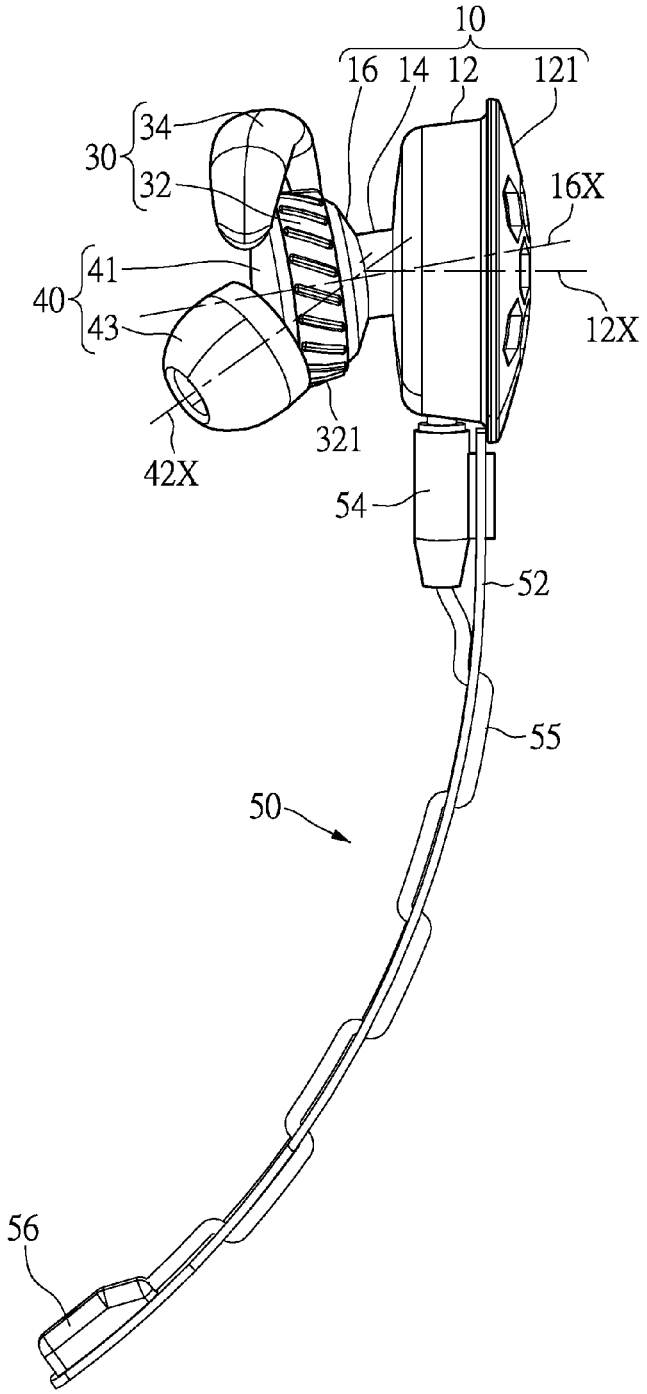
FIG. 4 is front view of the in-ear-canal headset assembly of the instant disclosure.
Figure 5:
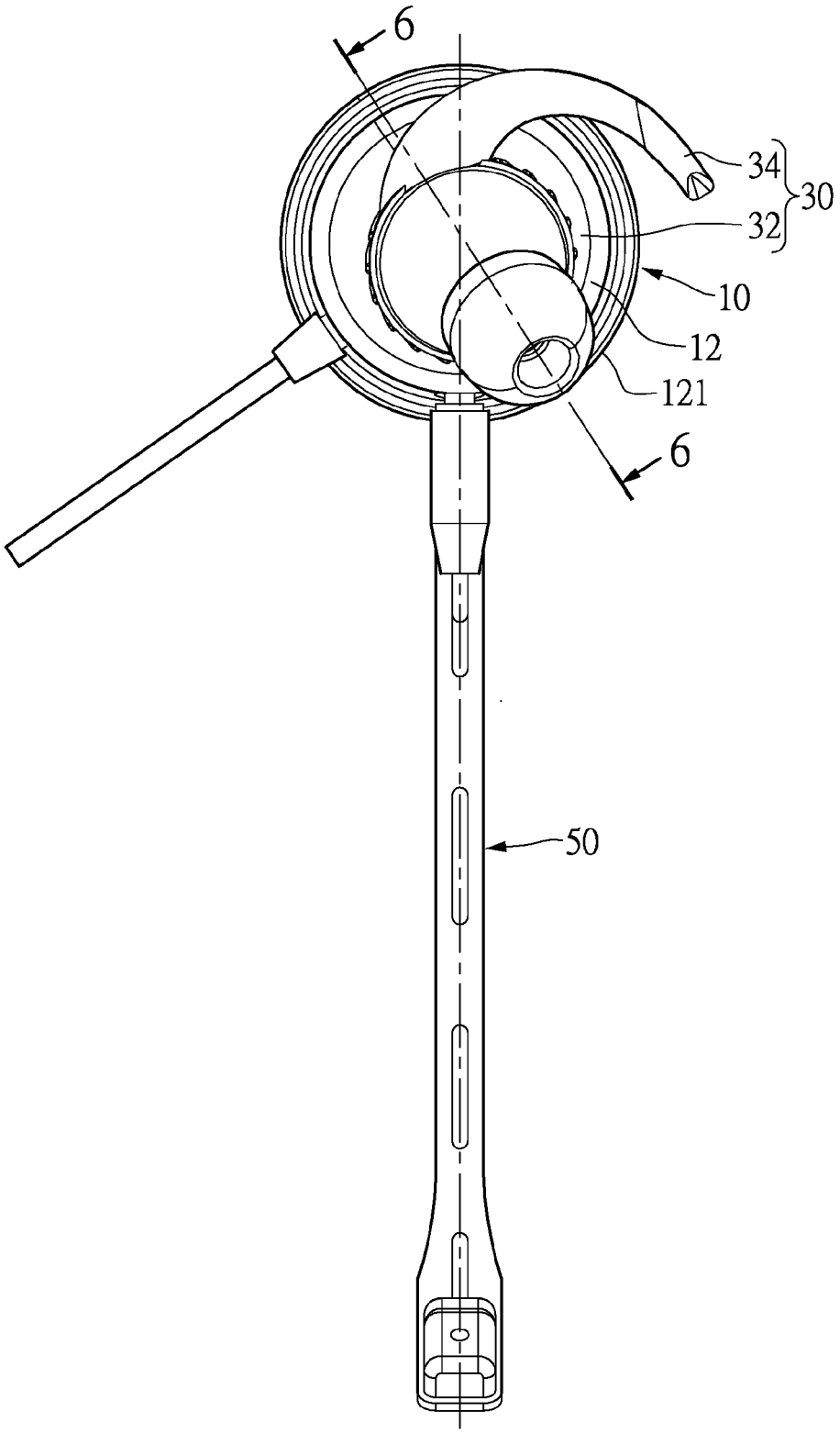
FIG. 5 is a side view of the in-ear-canal headset assembly of the instant disclosure.

Please refer to FIG. 3 to FIG. 5. FIG. 3 is a perspective view of the in-ear-canal headset assembly of the instant disclosure. FIG. 4 and FIG. 5 are plan views. In this embodiment, the resonance chamber 12 is shaped as a flat soup bowl, which on one hand can provide room for resonance to the speaker unit 20, and on the other hand can receive the socket 18. Since the plugging slot 180 of the socket 18 is substantially parallel to user's cheek, the instant disclosure can reduce the thickness of the resonance chamber 12. When user does not need to use the microphone, the microphone unit 50 can be dismounted. The cable 19 connected to the computer extends into the resonance chamber 12.

Figure 6:
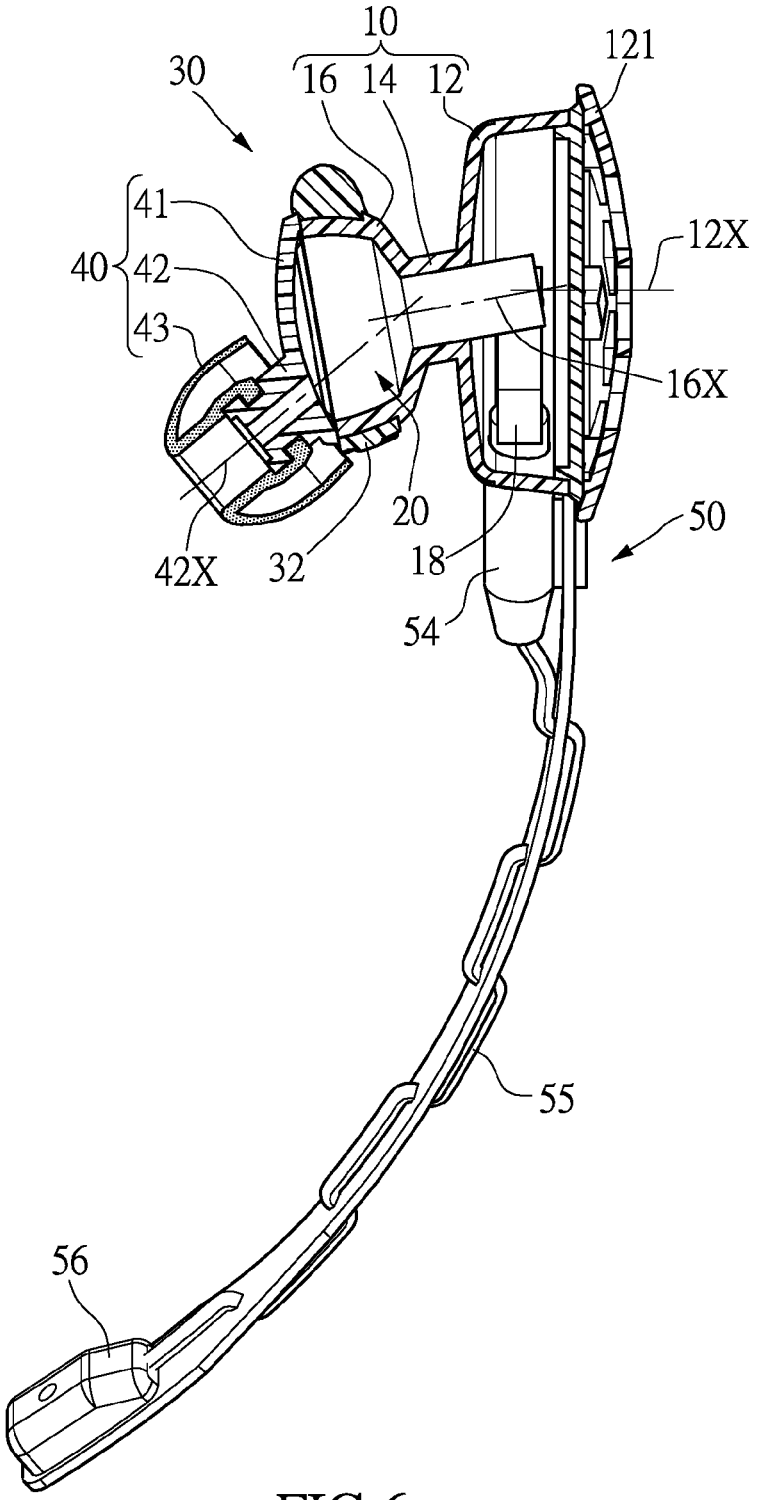
FIG. 6 is a cross-sectional view along a line 6-6 in FIG. 5 of the instant disclosure.

Please refer to FIG. 6, which is a cross-sectional view along a line 6-6 of FIG. 5 in the instant disclosure. An obtuse angle is formed between a channel axis 42*x*, of the wave-guiding tube 42 and a channel axis 16*x*, of the sound chamber 16. An obtuse angle is formed between the channel axis 16*x*, of the sound chamber 16 and an axis 12*x*, of the resonance chamber 12.

Please refer to FIG. 7, which is a perspective view of the in-ear-canal headset assembly being worn in accordance with the instant disclosure. After a user U wore the in-ear-canal headset assembly of this embodiment, the crescent-shaped hooking portion 34 of the fixing unit 30 is rested on user's ear E. The hooking portion 34 can increase the wearing stability, and work against the rotating torque. Besides, by the in-ear structure, the flexible tip 43 is put into user's canal to not only increase sound isolation effectiveness and isolate ambient noise, but also increase wearing stability of in-ear-canal headset assembly.

The descriptions illustrated supra set forth simply the preferred embodiments of the instant disclosure; however, the characteristics of the instant disclosure are by no means restricted thereto. All changes, alternations, or modifications conveniently considered by those skilled in the art are deemed to be encompassed within the scope of the instant disclosure delineated by the following claims.

What is claimed is:

1. An in-ear-canal headset assembly, comprising:

an accommodating housing having a resonance chamber, a sound chamber in air communication with the resonance chamber, and an outer cover arranged at a side of the resonance chamber, wherein a socket is received in the resonance chamber; wherein the accommodating housing further includes a neck portion in air communication with the resonance chamber and the sound chamber, wherein the sound chamber has a blocking protrusion arranged on a periphery thereof adjacent to the neck portion;

a speaker unit received in the sound chamber;

a fixing unit having a ring portion and a hooking portion connected to a periphery of the ring portion, the ring portion disposed around a periphery of the sound chamber;

an in-ear unit having a covering lid covering the sound chamber, a wave-guiding tube extending outward from the covering lid, and a flexible tip connected to one end of the wave-guiding tube; and a microphone unit, having an arm, an earphone plug disposed at one end of the arm and plugged in the socket, a microphone disposed on another end of the arm, and a connecting cord fixed on the arm, wherein the earphone plug is extended along a longitudinal direction of the arm, wherein the connecting cord is electrically connected to the earphone plug and the microphone.

2. The in-ear-canal headset assembly according to claim 1, wherein the socket has a plugging slot, and the plugging slot is substantially configured in parallel to a human cheek.

3. The in-ear-canal headset assembly according to claim 1, wherein the sound chamber and the neck portion are shaped as a funnel, the sound chamber is gradually narrowed from one end of the covering lid toward the neck portion, wherein the ring portion of the fixing unit has an inner opening adjacent to the covering lid and an outer opening adjacent to the neck portion, a diameter of the inner opening is bigger than a diameter of the outer opening.

4. The in-ear-canal headset assembly according to claim 3, wherein a diameter of the covering lid is larger than a diameter of the inner opening, the covering lid and the blocking protrusion block two sides of the ring portion.

5. The in-ear-canal headset assembly according to claim 3, wherein the fixing unit has a plurality of anti-sliding portions formed on an outer surface of the ring portion.

6. The in-ear-canal headset assembly according to claim 1, wherein an obtuse angle is formed between a channel axis of the wave-guiding tube and a channel axis of the sound chamber, and an obtuse angle is formed between the channel axis of the sound chamber and an axis of the resonance chamber.

7. The in-ear-canal headset assembly according to claim 1, wherein the arm of the microphone unit is plate shaped, the arm has a plurality of through holes formed thereon and two sides, the connecting cord passes through the through holes and is alternately arranged on the two sides of the arm in a wavelike pattern.

8. The in-ear-canal headset assembly according to claim 7, wherein the earphone plug of the microphone unit and the microphone are arranged on a same side of the plate-shaped arm.

9. The in-ear-canal headset assembly according to claim 7, wherein the arm and the hooking portion extend in opposite directions.

* * * * *